US011084636B2

(12) United States Patent
Wu

(10) Patent No.: US 11,084,636 B2
(45) Date of Patent: Aug. 10, 2021

(54) PACKING BOX FOR DISPLAY PANEL, AND ACCOMMODATING APPARATUS

(71) Applicants: CHONGQING ADVANCE DISPLAY TECHNOLOGY RESEARCH, Chongqing (CN); CHONGQING HKC OPTOELECTRONICS TECHNOLOGY CO., LTD., Chongqing (CN)

(72) Inventor: Qiong Wu, Chongqing (CN)

(73) Assignees: CHONGQING ADVANCE DISPLAY TECHNOLOGY RESEARCH, Chongqing (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 32 days.

(21) Appl. No.: 16/463,376

(22) PCT Filed: Nov. 9, 2018

(86) PCT No.: PCT/CN2018/114690
§ 371 (c)(1),
(2) Date: May 23, 2019

(87) PCT Pub. No.: WO2020/087561
PCT Pub. Date: May 7, 2020

(65) Prior Publication Data

US 2020/0331673 A1 Oct. 22, 2020

(30) Foreign Application Priority Data

Oct. 30, 2018 (CN) ..... 201821774550.9

(51) Int. Cl.
*B65D 51/30* (2006.01)
*B65D 81/113* (2006.01)
(Continued)

(52) U.S. Cl.
CPC ..... *B65D 51/30* (2013.01); *B65D 81/113* (2013.01); *B65D 81/26* (2013.01); *B65D 85/48* (2013.01); *B65D 2585/6837* (2013.01)

(58) Field of Classification Search
CPC ..... B65D 51/30; B65D 85/48; B65D 81/053; B65D 81/113; B65D 81/26; B65D 81/266; B65D 2585/6837
(Continued)

(56) References Cited

U.S. PATENT DOCUMENTS 5,730,785 A 3/1998 Idol et al.
2014/0131240 A1* 5/2014 Zhao ..... B65D 85/48 206/451
(Continued)

FOREIGN PATENT DOCUMENTS

CN 201745932 U 2/2011
CN 203838419 U 6/2014
(Continued)

OTHER PUBLICATIONS

Chuanlu Cao, the ISA written comments, Apr. 2019, CN.

*Primary Examiner* — Rafael A Ortiz

(57) ABSTRACT

This application discloses a packing box for a display panel and an accommodating apparatus. The packing box includes: a box body; the display panel including a circuit board and a substrate; and grooves, disposed on the box body, located on both sides of the circuit board, attached to the circuit board and the substrate, and configured to place a desiccant.

15 Claims, 5 Drawing Sheets

(51) Int. Cl.
*B65D 81/26* (2006.01)
*B65D 85/48* (2006.01)

(58) Field of Classification Search
USPC ..... 206/701, 706, 707, 710, 711, 722–724, 206/453, 454, 586, 591, 592, 594, 449, 206/455, 204
See application file for complete search history.

(56) References Cited

U.S. PATENT DOCUMENTS

| | | | | |
|---|---|---|---|---|
| 2014/0138377 | A1* | 5/2014 | Kuo | B65D 21/086 220/4.28 |
| 2014/0311935 | A1* | 10/2014 | Yue | B65D 25/10 206/454 |
| 2020/0130916 | A1* | 4/2020 | Lv | F25D 31/005 |

FOREIGN PATENT DOCUMENTS

| | | | | |
|---|---|---|---|---|
| CN | 104495079 | A | 4/2015 | |
| CN | 2016/070421 | * | 12/2016 | |
| JP | 2014218272 | A | 11/2014 | |
| WO | WO-2014040346 | A1 * | 3/2014 | H01L 21/67369 |
| WO | WO-2019049286 | A1 * | 3/2019 | B65D 85/68 |
| WO | WO-2019049311 | A1 * | 3/2019 | B65D 81/113 |

* cited by examiner

PACKING BOX FOR DISPLAY PANEL, AND ACCOMMODATING APPARATUS

This application claims priority to Chinese Patent Application No. CN201821774550.9, filed with the Chinese Patent Office on Oct. 30, 2018 and entitled "PACKING BOX FOR DISPLAY PANEL, AND ACCOMMODATING APPARATUS", which is incorporated herein by reference in its entirety.

TECHNICAL FIELD

This application relates to the field of display technologies, and in particular to a packing box for a display panel, and an accommodating apparatus.

BACKGROUND

The description herein provides only background information related to this application, but does not necessarily constitute the existing technology.

Displays controlled by an active switch include a liquid crystal display, an organic light-emitting diode ((SLED) display, and the like. The liquid crystal display has many advantages such as thin body, power saving, no radiation and the like, and has been widely used. The working principle of the liquid crystal panel is to place liquid crystal molecules between two parallel glass substrates, and apply driving voltage on the two glass substrates to control the rotation direction of the liquid crystal molecules, thereby refracting the light of the backlight module to generate a picture. The OLED display has many advantages such as autoluminescence, short response time, high definition and contrast, and realizes flexible display and large-area full-color display. Superior performance and huge market potential of the OLED display have attracted many manufacturers and scientific research institutions all over the world to invest in the production and research and development of OLED display panels.

The foam material packing box is commonly used in the display panel industry known to the inventors. In order to reduce the risk of moisture and terminal corrosion of a liquid crystal panel during storage and transportation, a desiccant is placed in the packing box.

A desiccant placement groove known to the inventors is disposed on a side wall of a box body, but there is not sufficient space on the side wall of the box body to place a desiccant.

SUMMARY

An objective of this application is to provide a packing box for a display panel and an accommodating apparatus, to provide sufficient space for placing a desiccant without changing the size of a box body.

To achieve the above objective, this application provides a packing box for a display panel. The packing box comprises: a box body for accommodating the display panel, wherein the display panel comprises a circuit board and a substrate, the circuit board is located on one side of the substrate, and the length of the circuit board is shorter than the length of the substrate; and grooves disposed on the box body, located on both sides of the circuit board and attached to the circuit board and the substrate, the grooves being configured to place a desiccant.

Optionally, the box body comprises insert blocks, the insert blocks are configured to protect the display panel, the insert block comprises an accommodating slot, the accommodating slot is located in the insert block, the quantity of the insert blocks and the grooves are respectively two, the grooves are axial symmetrically distributed on the box body, the insert block is connected with the groove, the insert block is fixed in a side wall of the groove, and the desiccant is placed in the accommodating slot.

Optionally, the insert block comprises a through hole, the through hole is disposed on a convex plate of the insert block adjacent to the inside of the box body, and the through hole communicates the accommodating slot with the inside of the box body.

Optionally, the insert block comprises a first convex plate and a second convex plate, the box body comprises a first groove, the first convex plate and the second convex plate are in the shape of a rectangular parallelepiped, the first convex plate is fixedly connected with the insert block, the second convex plate is fixedly connected with the first convex plate, the first groove is disposed on a side wall of the box body, the shape and size of the first convex plate and the second convex plate are equal to the shape and size of the first groove, and the first convex plate and the second convex plate are matched with the first groove.

Optionally, the groove is in the shape of a rectangular parallelepiped slot, the shape and size of the insert block correspond to those of the groove, and the insert block has a thickness in a range of 2 mm to 4 mm.

Optionally, the insert block comprises a third convex plate, the third convex plate is adjacent to a side portion of the circuit board, the through hole is located on the third convex plate, the through hole is in the shape of a rectangular parallelepiped, the upper and lower ends of the through hole run through the top end and the bottom end of the insert block, the width of the through hole does not exceed the width of the circuit board, and the width direction of the through hole coincides with the width direction of the circuit board.

Optionally, the insert block comprises a fourth convex plate, a fifth convex plate and a buffer pad, the fourth convex plate is perpendicular to and fixedly connected with the fifth convex plate, the buffer pad is fixed to the outside of the fourth convex plate and the fifth convex plate, the buffer pad is a soft material, and the buffer pad is in contact with a top corner portion of the display panel.

Optionally, the insert block comprises a first surface and a second surface, the first surface is located on the bottom of the insert block and attached to the surface of the box body, the second surface is disposed in parallel to and opposite to the first surface, and the accommodating slot runs through the first surface and the second surface.

This application further discloses a packing box for a display panel. The packing box comprises: a box body for accommodating the display panel, wherein the display panel comprises a circuit board and a substrate, the circuit board is located on one side of the substrate, and the length of the circuit board is shorter than the length of the substrate; and grooves disposed on the box body, located on both sides of the circuit board and attached to the circuit board and the substrate, the grooves being configured to place a desiccant;

The box body comprises insert blocks, the insert blocks are configured to protect the display panel, the insert block comprises an accommodating slot, the accommodating slot is located in the insert block, the quantity of the insert blocks and the grooves are respectively two, the grooves are axial symmetrically distributed on the box body, the insert block is connected with the groove, the insert block is fixed in a side wall of the groove, and the desiccant is placed in the accommodating slot. The insert block comprises a through hole, the through hole is disposed on a convex plate of the insert block adjacent to the inside of the box body, and the through hole communicates the accommodating slot with the inside of the box body. The insert block comprises a first convex plate and a second convex plate, the box body comprises a first groove, the first convex plate and the second convex plate are in the shape of a rectangular parallelepiped, the first convex plate is fixedly connected with the insert block, the second convex plate is fixedly connected with the first convex plate, the first groove is disposed on a side wall of the box body, the shape and size of the first convex plate and the second convex plate are equal to the shape and size of the first groove, and the first convex plate and the second convex plate are matched with the first groove. The groove is in the shape of a rectangular parallelepiped slot, the shape and size of the insert block correspond to those of the groove, and the insert block has a thickness in a range of 2 mm to 4 mm. The insert block comprises a third convex plate, the third convex plate is adjacent to a side portion of the circuit board, the through hole is located on the third convex plate, the through hole is in the shape of a rectangular parallelepiped, the upper and lower ends of the through hole run through the top end and the bottom end of the insert block, and the width of the through hole does not exceed the width of the circuit board. The insert block comprises a fourth convex plate, a fifth convex plate and a buffer pad, the fourth convex plate is perpendicular to and fixedly connected with the fifth convex plate, the buffer pad is fixed to the outside of the fourth convex plate and the fifth convex plate, the buffer pad is a soft material, and the buffer pad is in contact with a top corner portion of the display panel. The insert block comprises a first surface and a second surface, the first surface is located on the bottom of the insert block and attached to the surface of the box body, the second surface is disposed in parallel to and opposite to the first surface, and the accommodating slot rims through the first surface and the second surface.

This application further discloses an accommodating apparatus, where the accommodating apparatus comprises packing boxes, the packing boxes are stacked, and the packing box comprises: a box body configured to accommodate a display panel; the display panel comprises a circuit board and a substrate, the circuit board is located on one side of the substrate, and the length of the circuit board is shorter than the length of the substrate; and grooves disposed on the box body, located on both sides of the circuit board and attached to the circuit board and the substrate, the grooves being configured to place a desiccant.

Optionally, the box body comprises insert blocks, the insert blocks are configured to protect the display panel, the insert block comprises an accommodating slot, the accommodating slot is located in the insert block, the quantity of the insert blocks and the grooves are respectively two, the grooves are axial symmetrically distributed on the box body, the insert block is connected with the groove, the insert block is fixed in a side wall of the groove, and the desiccant is placed in the accommodating slot.

Optionally, the insert block comprises a through hole, the through hole is disposed on a convex plate of the insert block adjacent to the inside of the box body, and the through hole communicates the accommodating slot with the inside of the box body.

Optionally, the insert block comprises a first convex plate and a second convex plate, the box body comprises a first groove, the first convex plate and the second convex plate are in the shape of a rectangular parallelepiped, the first convex plate is fixedly connected with the insert block, the second convex plate is fixedly connected with the first convex plate, the first groove is disposed on a side wall of the box body, the shape and size of the first convex plate and the second convex plate are equal to the shape and size of the first groove, and the first convex plate and the second convex plate are matched with the first groove.

Optionally, the groove is in the shape of a rectangular parallelepiped slot, the shape and size of the insert block correspond to those of the groove, and the insert block has a thickness in a range of 2 mm to 4 mm.

Optionally, the insert block comprises a third convex plate, the third convex plate is adjacent to a side portion of the circuit board, the through hole is located on the third convex plate, the through hole is in the shape of a rectangular parallelepiped, the upper and lower ends of the through hole run through the top end and the bottom end of the insert block, and the width of the through hole does not exceed the width of the circuit board.

Optionally, the insert block comprises a fourth convex plate, a fifth convex plate and a buffer pad, the fourth convex plate is perpendicular to and fixedly connected with the fifth convex plate, the buffer pad is fixed to the outside of the fourth convex plate and the fifth convex plate, the buffer pad is a soft material, and the buffer pad is in contact with a top corner portion of the display panel.

Optionally, the insert block comprises a first surface and a second surface, the first surface is located on the bottom of the insert block and attached to the surface of the box body, the second surface is disposed in parallel to and opposite to the first surface, and the accommodating slot rims through the first surface and the second surface.

Compared with the solution that the placement groove is disposed on the side wall of the box body, in this application, the length of the circuit board is shorter than the length of the substrate, and the circuit board is located on one side of the substrate, so that the box body of the packing box corresponding to the two ends of the side portion of the circuit board is very thick; and this part of the box body is set as the groove to reduce the wall thickness of the box body and place the desiccant, so that there is no need to change the size of the box body while ensuring sufficient space for placing the desiccant.

BRIEF DESCRIPTION OF DRAWINGS

The accompanying drawings included are used for helping understand the embodiments of this application, constitute a part of this specification, illustrate examples of the embodiments of this application and, together with the description, serve to explain the principles of this application. Apparently, the accompanying drawings in the following description merely show some embodiments of this application, and persons of ordinary skill in the art may still derive other drawings from these accompanying drawings without creative effort. In the figures.

DETAILED DESCRIPTION

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly include one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

Figure 1:
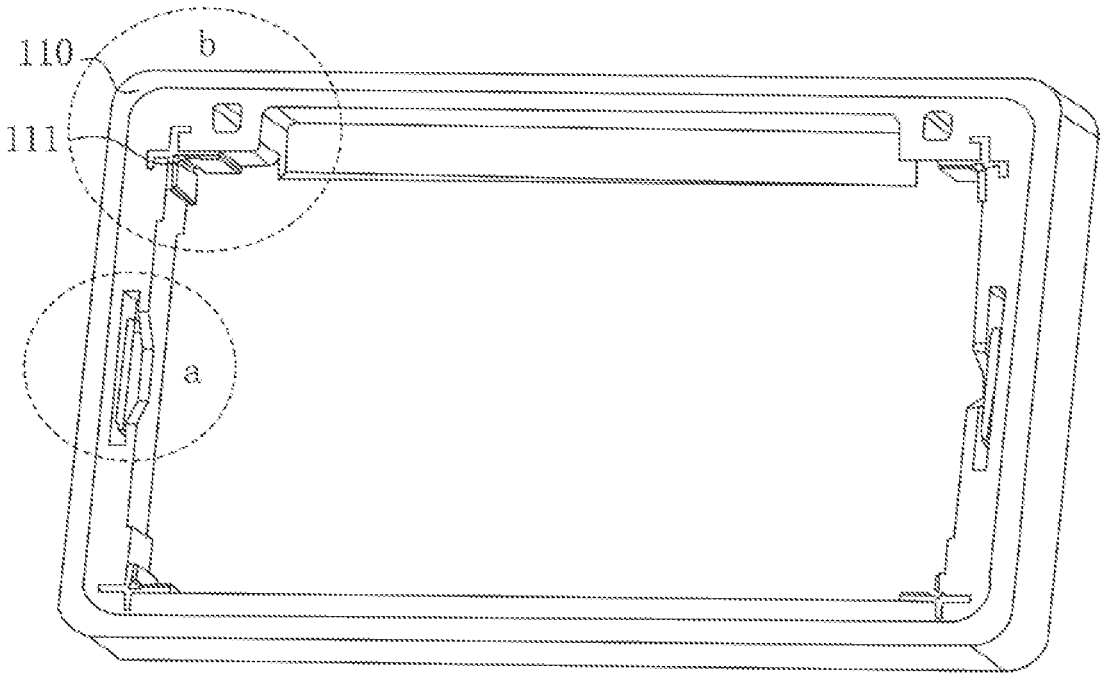
FIG. 1 is a schematic structural diagram of a packing box according to an embodiment of this application.
Figure 2:
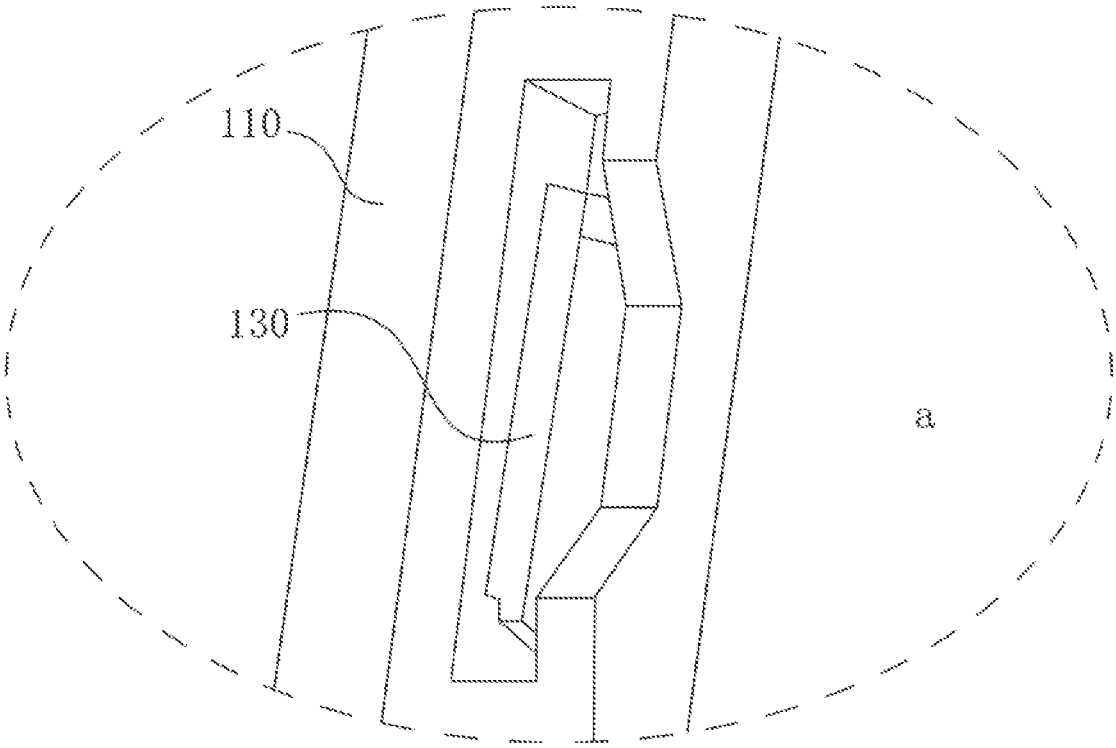
FIG. 2 is a partially enlarged schematic structural diagram of a packing box placing a desiccant according to an embodiment of this application.
Figure 3:
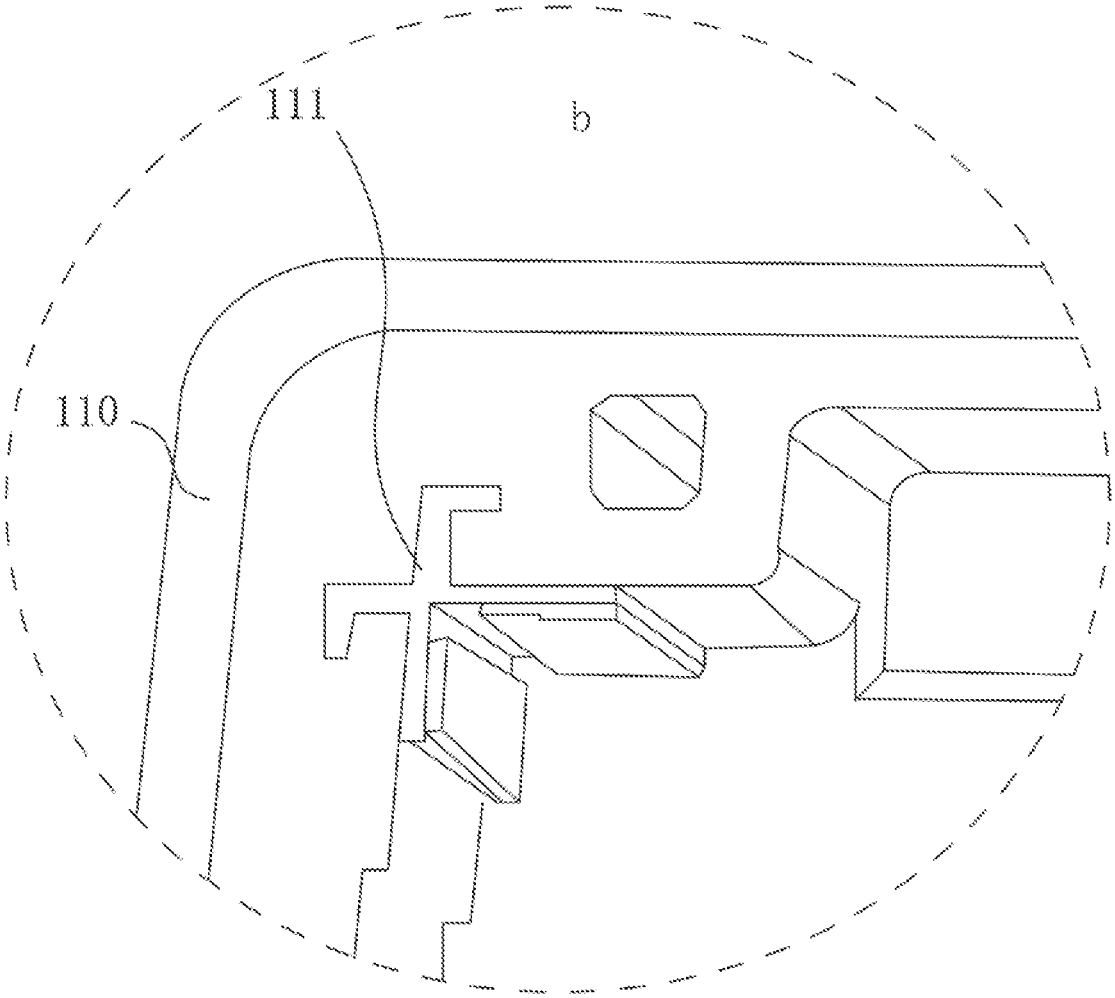
FIG. 3 is a partially enlarged, schematic structural diagram of a packing box placing an insert block according to an embodiment of this application.

The foam material packing box is commonly used in the display panel industry. In order to reduce the risk of moisture and terminal corrosion of the display panel during storage and transportation, a desiccant 130 is placed in the packing box. As shown in FIG. 1 to FIG. 3, a known desiccant 130 placement groove is disposed on a side wall of a box body 110. If the width of the placement groove is too small, the desiccant 130 that satisfies the usage amount may not be placed therein, and if the width of the placement groove is too large, the foam material may not be formed or may be easily damaged. However, in order to match the size of the pallet in the factory or reduce the weight of the small and medium-sized display panel, on the premise of ensuring the strength of the box body 110, the thickness of the side wall of the packing box is generally designed to be relatively thin to reduce costs, resulting in no sufficient space for placing the desiccant 130 on the side wall of the box body 110.

This application is optionally described below with reference to the accompanying drawings and optional embodiments.

Figure 4:
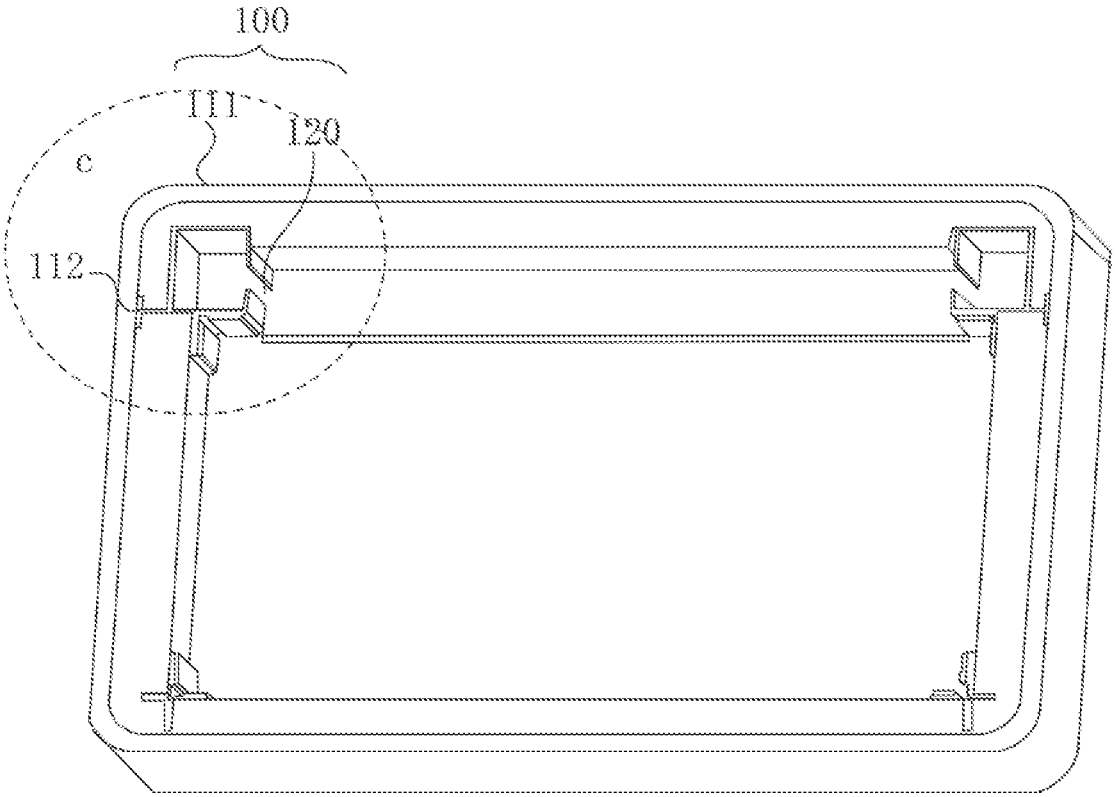
FIG. 4 is a schematic structural diagram of a packing box placing an insert block according to an embodiment of this application.
Figure 5:
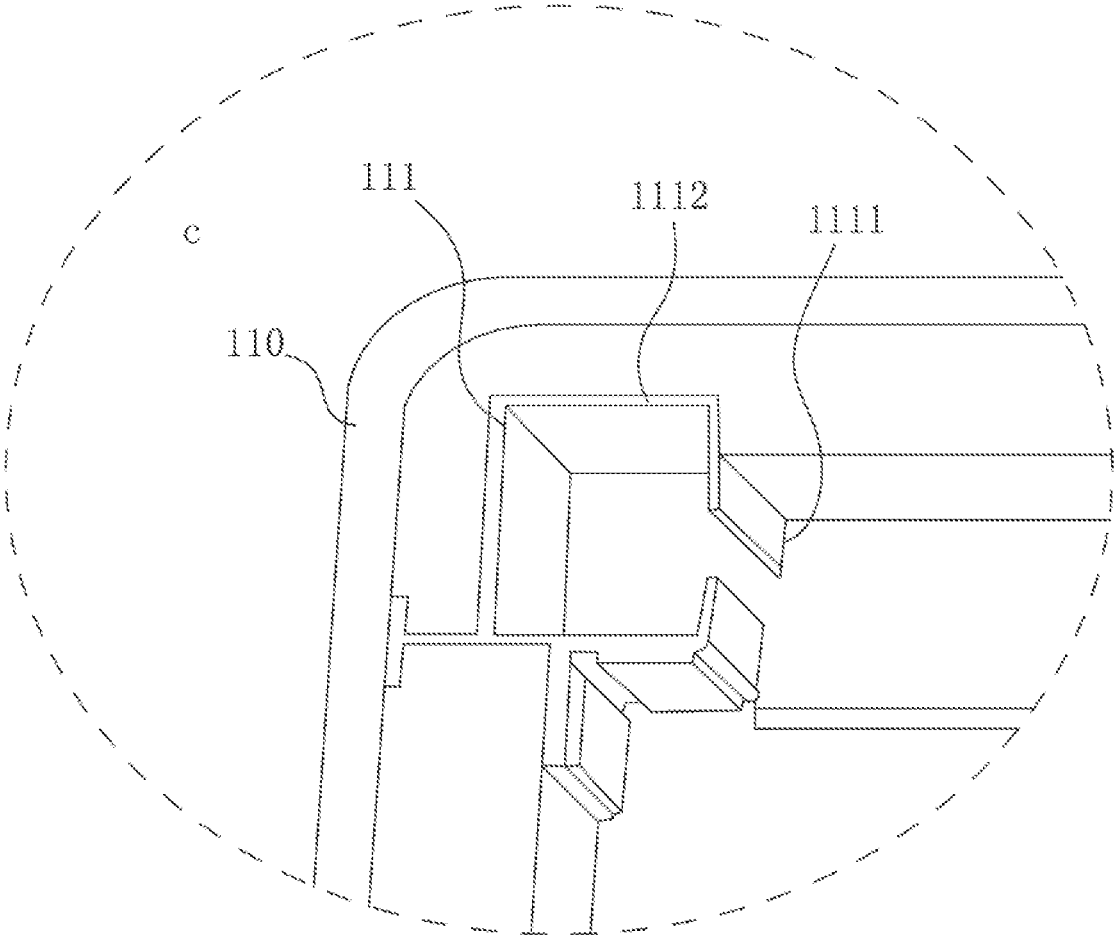
FIG. 5 is a partially enlarged schematic structural diagram of a packing box placing an insert block according to an embodiment of this application.
Figure 6:
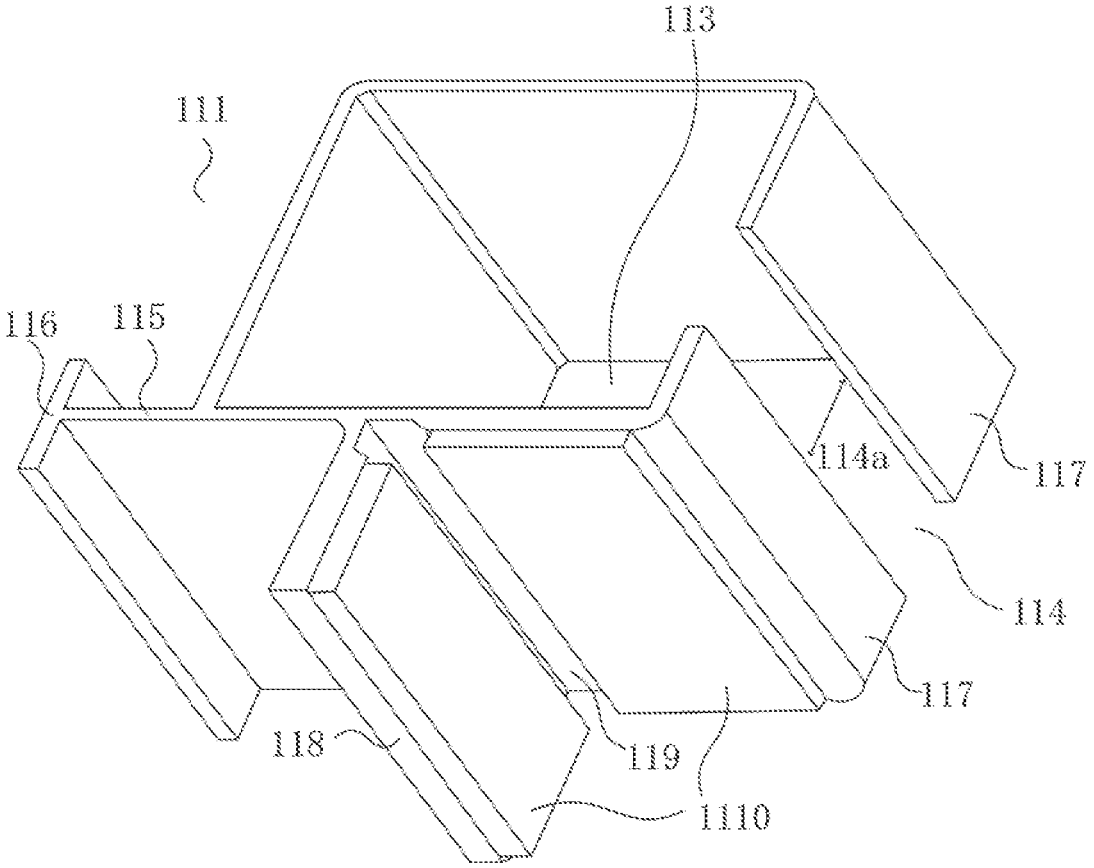
FIG. 6 is a schematic structural diagram of an insert block according to an embodiment of this application.

As shown in FIG. 4 to FIG. 6, an embodiment of this application discloses a packing box 100 for a display panel, including: a box body 110 for accommodating the display panel, where the display panel includes a circuit board and a substrate, the circuit board is located on one side of the substrate, and the length of the circuit board is shorter than the length of the substrate; and grooves 120 disposed on the box body 110, located on both sides of the circuit board and attached to the circuit board and the substrate, the grooves 120 being configured to place a desiccant 130.

The length of the circuit board is shorter than the length of the substrate, and the circuit board is located on one side of the substrate, so that the box body 110 of the packing box 100 corresponding to the two ends of a side portion of the circuit board is very thick; and this part of the box body 110 is set as the groove 120 to reduce the wall thickness of the box body 110 and place the desiccant 130, so that there is no need to change the size of the box body 110 while ensuring sufficient space for placing the desiccant 130.

In an embodiment, the box body 110 includes insert blocks 111, the insert blocks 111 are configured to protect the display panel, the insert block 111 includes an accommodating slot 113, the accommodating slot 113 is located in the middle of the insert block 111, the quantity of the insert blocks 111 and the grooves 120 are respectively two, the grooves 120 are axial symmetrically distributed on the box body 110, the insert block 111 is connected with the groove 120, the insert block 111 is fixed in a side wall of the groove 120, and the desiccant 130 is placed in the accommodating slot 113.

The insert blocks 111 are configured to protect the display panel, the insert blocks 111 are disposed on both sides of the top of the display panel, and the groove 120 and the insert block 111 are at the same position of the box body 110, so that the shape of the insert block 111 is changed by adding the accommodating slot 113 so as to fix the desiccant 130, thereby increasing space utilization inside the box body 110.

In an embodiment, the insert block 111 includes a through hole 114, the through hole 114 is disposed on a convex plate of the insert block 111 adjacent to the inside of the box body 110, and the through hole 114 communicates the accommodating slot 113 with the inside of the box body 110.

The box bodies 110 are all stacked during the transportation of the display panels, the upper box body 110 is pressed on the lower box body 110, and the opening direction of the groove 120 is upward, so that it is difficult for the desiccant 130 to dry the display panel during the transportation; and therefore, the through hole 114 is disposed on the convex plate of the insert block 111 adjacent to the inside of the box body 110 to ensure air circulation between the desiccant 130 and the space inside the box body 110, thereby achieving the drying effect on the display panel.

In an embodiment, the insert block 111 includes a first convex plate 115 and a second convex plate 116, the box body 110 includes a first groove 112, the first convex plate 115 and the second convex plate 116 are in the shape of a rectangular parallelepiped sheet, the first convex plate 115 is fixedly connected with the insert block 111, the second convex plate 116 and the first convex plate 115 are fixedly connected and are perpendicular to each other, the first groove 112 is disposed on a side wall of the box body 110, the shape and size of the first convex plate 115 and the second convex plate 116 are equal to the shape and size of the first groove 112, and the first convex plate 115 and the second convex plate 116 are matched with the first groove 112.

The shape and size of the first convex plate 115 and the second convex plate 116 are equal to the shape and size of the first groove 112, so that the first convex plate 115 and the second convex plate 116 can be more closely matched with the first groove 112. When the insert block 111 is mounted, the first convex plate 115 and the second convex plate 116 are matched with the first groove 112, and the first convex plate 115 and the second convex plate 116 increase the contact area between the insert block 111 and the box body 110 and correspondingly increase the friction force between the insert block 111 and the box body 110, so that the insert block 111 is not easily detached from the box body 110. The second convex plate 116 and the first convex plate 115 are fixedly connected and are perpendicular to each other, thereby limiting the movement in the horizontal direction of the insert block 111 in all directions and increasing the stability of the insert block 111.

In an embodiment, the groove 120 is in the shape of a rectangular parallelepiped slot, the shape and size of the insert block 111 correspond to those of the groove 120, and the insert block 111 has a thickness in a range of 2 mm to 4 mm.

The rectangular parallelepiped slot is relatively regular and has parallel opposite sides, and the groove 120 is located adjacent to two right-angled portions of the box body 110. The groove 120 is in the shape of a rectangular parallelepiped slot, so that the wall thickness of the right-angled portion of the box body 110 is relatively more uniform, thereby correspondingly increasing the strength of the structure of the box body 110. The volume of the rectangular parallelepiped is larger than that of other shapes, and thus, can accommodate more desiccant 130. The shape and size of the insert block 111 correspond to those of the groove 120, so that the occupied space of the insert block 111 can be reduced, and more desiccant 130 can be placed to enhance the drying effect. The insert block 111 has a thickness in a range of 2 mm to 4 mm, so that the space inside the box body 110 is efficiently utilized and the structural strength of the insert block 111 can be ensured, and therefore, the insert block 111 is matched with the groove 120 more closely, thereby preventing the insert block 111 from being detached from the box body 110.

In an embodiment, the insert block 111 includes a third convex plate 117, the third convex plate 117 is located on the side portion of the circuit board, the through hole 114 is located on the third convex plate 117, the through hole 114 is in the shape of a rectangular parallelepiped, the upper and lower ends of the through hole 114 run through the top end and the bottom end of the insert block 111, the width 114*a* of the through hole does not exceed the width of the circuit board, and the width 114*a* direction of the through hole coincides with the width direction of the circuit board.

The third convex plate 117 is located on the side portion of the circuit board, and the through hole 114 is located on the third convex plate 117, thereby reducing the distance between the desiccant 130 and the circuit board and enhancing the drying effect of the desiccant 130. The upper and lower ends of the through hole 114 run through the top end and the bottom end of the insert block 111, and the size of the through hole 114 can be increased, thereby correspondingly accelerating air circulation between the desiccant 130 and the box body 110, and enhancing the drying effect of the desiccant 130. Since the third convex plate 117 is located on the side portion of the circuit board, the third convex plate 117 can also give the circuit board supporting force to reduce the shaking of the circuit board, so that the width of the through hole 114 does not exceed the width of the circuit board, and thus, the third convex plate 117 has sufficient stressed area to contact the circuit board, thereby ensuring the stability of the display panel in the box body 110.

In an embodiment, the insert block 111 includes a fourth convex plate 118, a fifth convex plate 119 and a buffer pad 1110, the fifth convex plate 119 is located on a lower portion of the insert block 111, the fourth convex plate 118 is perpendicular to and fixedly connected with the fifth convex plate 119, the buffer pad 1110 is fixed to the outside of the fourth convex plate 118 and the fifth convex plate 119, the buffer pad 1110 is a soft material, and the buffer pad 1110 is in contact with a top corner portion of the display panel.

The position of the fifth convex plate 119 corresponds to the top corner portion of the display panel, and the top corner of the display panel is relatively weak, so that the insert block 111 needs to be changed to protect the top corner of the display panel from damage. The top corner of the display panel is a right angle, so that the fourth convex plate 118 and the fifth convex plate 119 are perpendicularly and fixedly connected to form a right angle to ensure that the insert block 111 is more fully in contact with the top corner of the display panel. The buffer pad 1110 is fixed to the outside of the fourth convex plate 118 and the fifth convex plate 119, the buffer pad 1110 is a soft material, and the buffer pad 1110 protects the top corner of the display panel, thereby reducing the damage of the display panel caused by the shaking or impact of the box body 110.

In an embodiment, the accommodating slot 113 runs through the upper and lower ends of the insert block 111. The insert block 111 includes a first surface 1111 and a second surface 1112, the first surface 1111 is located on the bottom of the insert block 111 and attached to the surface of the box body 110, the second surface 1112 is disposed in parallel to and opposite to the first surface 1111, and the accommodating slot 113 runs through the first surface 1111 and the second surface 1112.

The quantity of the insert blocks 111 is two, the insert blocks have equal shape and size, and the accommodating slot 113 is one slot, so that the insert block 111 may be mounted reversely or incorrectly. Under the condition that the insert block 111 is mounted reversely, the bottom of the accommodating slot 113 faces the top, and thus, the desiccant 130 cannot be placed in the insert block 111; and therefore, the accommodating slot 113 runs through the upper and lower ends of the insert block 111 to avoid incorrect mounting of the insert block 111. When the insert block 111 is at different positions, the effect is the same, and the desiccant 130 can be placed therein, thereby facilitating the mounting by users and avoiding incorrect mounting.

In another embodiment of this application, with reference to FIG. 4 to FIG. 6, a packing box 100 for a display panel is disclosed, including: a box body 110 for accommodating the display panel, where the display panel includes a circuit board and a substrate, the circuit board is located on one side of the substrate, and the length of the circuit board is shorter than the length of the substrate; and grooves 120, disposed on the box body 110, located on both sides of the circuit board and attached to the circuit board and the substrate, the grooves 120 being configured to place a desiccant 130;

The box body 110 includes insert blocks 111, the insert blocks 111 are configured to protect the display panel, the insert block 111 includes an accommodating slot 113, the accommodating slot 113 is located in the middle of the insert block 111, the quantity of the insert blocks 111 and the grooves 120 are respectively two, the grooves 120 are axial symmetrically distributed on the box body 110, the insert block 111 is connected with the groove 120, the insert block 111 is fixed in a side wall of the groove 120, and the desiccant 130 is placed in the accommodating slot 113. The insert block 111 includes a through hole 114, the through hole 114 is disposed on a convex plate of the insert block 111 adjacent to the inside of the box body 110, and the through hole 114 communicates the accommodating slot 113 with the inside of the box body 110.

The insert block 111 includes a first convex plate 115 and a second convex plate 116, the box body 110 includes a first groove 112, the first convex plate 115 and the second convex plate 116 are in the shape of a rectangular parallelepiped sheet, the first convex plate 115 is fixedly connected with the insert block 111, the second convex plate 116 and the first convex plate 115 are fixedly connected and are perpendicular to each other, the first groove 112 is disposed on a side wall of the box body 110, the shape and size of the first convex plate 115 and the second convex plate 116 are equal to the shape and size of the first groove 112, and the first convex plate 115 and the second convex plate 116 are matched with the first groove 112. The groove 120 is in the shape of a rectangular parallelepiped slot, the shape and size of the insert block 111 correspond to those of the groove 120, and the insert block 111 has a thickness in a range of 2 mm to 4 mm.

The insert block 111 includes a third convex plate 117, the third convex plate 117 is located on a side portion of the circuit board, the through hole 114 is located on the third convex plate 117, the through hole 114 is in the shape of a rectangular parallelepiped, the upper and lower ends of the through hole 114 run through the top end and the bottom end of the insert block 111, and the width of the through hole 114 does not exceed the width of the circuit board. The insert block 111 includes a fourth convex plate 118, a fifth convex plate 119 and a buffer pad 1110, the fifth convex plate 119 is located on a lower portion of the insert block 111, the fourth convex plate 118 is perpendicular to and fixedly connected with the fifth convex plate 119, the buffer pad 1110 is fixed to the outside of the fourth convex plate 118 and the fifth convex plate 119, the buffer pad 1110 is a soft material, and the buffer pad 1110 is in contact with a top corner portion of the display panel. The first convex plate 115 is located on a side portion of the fifth convex plate 119, the side surface of the first convex plate 115 is in the same plane as the side surface of the fifth convex plate 119, and the first convex plate 115 is fixedly connected with the fifth convex plate 119. The insert block 111 includes a first surface 1111 and a second surface 1112, the first surface 1111 is located on the bottom of the insert block 111 and attached to the surface of the box body 110, the second surface 1112 is disposed in parallel to and opposite to the first surface 1111, and the accommodating slot 113 runs through the first surface 1111 and the second surface 1112.

The insert blocks 111 are configured to protect the display panel, the insert blocks 111 are disposed on both sides of the top of the display panel, and the groove 120 and the insert block 111 are at the same position of the box body 110, so that the shape of the insert block 111 is changed by adding the accommodating slot 113 so as to fix the desiccant 130, thereby increasing space utilization inside the box body 110. The box bodies 110 are all stacked during the transportation of the display panels, the upper box body 110 is pressed on the lower box body 110, and the opening direction of the groove 120 is upward, so that it is difficult for the desiccant 130 to dry the display panel during the transportation; and therefore, the through hole 114 is disposed on the convex plate of the insert block 111 adjacent to the inside of the box body 110 to ensure air circulation between the desiccant 130 and the space inside the box body 110, thereby drying the display panel.

The shape and size of the first convex plate 115 and the second convex plate 116 are equal to the shape and size of the first groove 112, so that the first convex plate 115 and the second convex plate 116 can be more closely matched with the first groove 112. When the insert block 111 is mounted, the first convex plate 115 and the second convex plate 116 are matched with the first groove 112, and the first convex plate 115 and the second convex plate 116 increase the contact area between the insert block 111 and the box body 110 and correspondingly increase the friction force between the insert block 111 and the box body 110, so that the insert block 111 is not easily detached from the box body 110. The second convex plate 116 and the first convex plate 115 are fixedly connected and are perpendicular to each other, thereby limiting the movement in the horizontal direction of the insert block 111 in all directions and increasing the stability of the insert block 111. The rectangular parallelepiped slot is relatively regular and has parallel opposite sides, and the groove 120 is located adjacent to two right-angled portions of the box body 110. The groove 120 is in the shape of a rectangular parallelepiped slot, so that the wall thickness of the right-angled portion of the box body 110 is relatively more uniform, thereby correspondingly increasing the strength of the structure of the box body 110. The volume of the rectangular parallelepiped is larger than that of other shapes, and thus, can accommodate more desiccant 130. The shape and size of the insert block 111 correspond to those of the groove 120, so that the occupied space of the insert block 111 can be reduced, and more desiccant 130 can be placed to enhance the drying effect. The insert block 111 has a thickness in a range of 2 mm to 4 mm, so that the space inside the box body 110 is efficiently utilized and the structural strength of the insert block 111 can be ensured, and therefore, the insert block 111 is matched with the groove 120 more closely, thereby preventing the insert block 111 from being detached from the box body 110.

The third convex plate 117 is located on the side portion of the circuit board, and the through hole 114 is located on the third convex plate 117, thereby reducing the distance between the desiccant 130 and the circuit board and enhancing the drying effect of the desiccant 130. The upper and lower ends of the through hole 114 run through the top end and the bottom end of the insert block 111, and the size of the through hole 114 can be increased, thereby correspondingly accelerating air circulation between the desiccant 130 and the box body 110, and enhancing the drying, effect of the desiccant 130. Since the third convex plate 117 is located on the side portion of the circuit board, the third convex plate 117 can also give the circuit board supporting force to reduce the shaking of the circuit board, so that the width of the through hole 114 does not exceed the width of the circuit board, and thus, the third convex plate 117 has sufficient stressed area to contact the circuit board, thereby ensuring the stability of the display panel in the box body 110. The position of the fifth convex plate 119 corresponds to the top corner portion of the display panel, and the top corner of the display panel is relatively weak, so that the insert block 111 needs to be changed to protect the top corner of the display panel from damage. The top corner of the display panel is a right angle, so that the fourth convex plate 118 and the fifth convex plate 119 are perpendicularly and fixedly connected to form a right angle to ensure that the insert block 111 is more fully in contact with the top corner of the display panel. The buffer pad 1110 is fixed to the outside of the fourth convex plate 118 and the fifth convex plate 119, the buffer pad 1110 is a soft material, and the buffer pad 1110 protects the top corner of the display panel, thereby reducing the damage of the display panel caused by the shaking or impact of the box body 110.

The side surface of the first convex plate 115 is in the same plane as the side surface of the fifth convex plate 119. Since the first convex plate 115 protrudes from the insert block 111 for fixing, in order to increase the fixing effect, the protruding position of the first convex plate 115 is on the fifth convex plate 119, so that the first convex plate 115 and the fifth convex plate 119 are integrated into a whole, thereby increasing the strength of the first convex plate and preventing the first convex plate 115 from being broken easily. The quantity of the insert blocks 111 is two, the insert blocks have equal shape and size, and the accommodating slot 113 is one slot, so that the insert block 111 may be mounted reversely or incorrectly. Under the condition that the insert block 111 is mounted reversely, the bottom of the accommodating slot 113 faces the top, and thus, the desiccant 130 cannot be placed in the insert block 111; and therefore, the accommodating slot 113 runs through the upper and lower ends of the insert block 111 to avoid incorrect mounting of the insert block 111. When the insert block 111 is at different positions, the effect is the same, and the desiccant 130 can be placed therein, thereby facilitating the user's mounting and avoiding incorrect mounting.

In another embodiment of this application, with reference to FIG. 3 to FIG. 6, an accommodating apparatus is disclosed, at least including two box bodies 110 of any embodiments, and the packing boxes 100 are stacked. For the transportation of the packing boxes 100, the packing boxes 100 need to be stacked layer by layer so as to obtain the maximum transportation space, increase the efficiency of single transportation and lower transportation costs.

The foregoing content is merely detailed descriptions of this application made with reference to specific optional implementations, and should not be considered as limiting of specific implementations of this application. Persons of ordinary skill in the art can further make simple deductions or replacements without departing from the concept of this application, and such deductions or replacements should all be considered as falling within the protection scope of this application.

What is claimed is:

1. A packing box for a display panel, the display panel comprising a circuit board and a substrate, wherein the circuit board is disposed on one side of the substrate, and a length of the circuit board is shorter than a length of the substrate, the packing box comprising:

a box body, configured to accommodate the display panel; and two grooves, disposed on the box body, wherein the box body comprises two insert blocks each configured to protect a corresponding to corner of the display panel, each of the two insert blocks comprises an accommodating slot located in the insert block, the two grooves are axial symmetrically distributed on the box body, each of the two insert blocks is connected with the corresponding groove and is fixed within side walls of the corresponding groove, and a desiccant is placed in the accommodating slot.

2. The packing box for the display panel according to claim 1, wherein the insert block comprises a through hole, the through hole is defined in a convex plate of the insert block adjacent to the inside of the box body, and the through hole communicates the accommodating slot with the inside of the box body.

3. The packing box for the display panel according to claim 1, wherein the insert block comprises a first convex plate and a second convex plate, the box body comprises a first groove, the first convex plate and the second convex plate are in the shape of a rectangular parallelepiped, the first convex plate is fixedly connected with the insert block, the second convex plate is fixedly connected with the first convex plate, the first groove is disposed on a side wall of the box body, the shape and size of the first convex plate and the second convex plate are equal to the shape and size of the first groove, and the first convex plate and the second convex plate are matched with the first groove.

4. The packing box for the display panel according to claim 1, wherein the groove is in the shape of a rectangular parallelepiped slot, the shape and size of the insert block correspond to those of the groove, and the insert block has a thickness in a range of 2 mm to 4 mm.

5. The packing box for the display panel according to claim 3, wherein the insert block comprises a third convex plate, the third convex plate is adjacent to a side portion of the circuit board, the through hole is located on the third convex plate, the through hole is in the shape of a rectangular parallelepiped, the upper and lower ends of the through hole run through the top end and the bottom end of the insert block, the width of the through hole does not exceed the width of the circuit board, and the width direction of the through hole coincides with the width direction of the circuit board.

6. The packing box for the display panel according to claim 5, wherein the insert block comprises a fourth convex plate, a fifth convex plate and a buffer pad, the fourth convex plate is perpendicular to and fixedly connected with the fifth convex plate, the buffer pad is fixed to the outside of the fourth convex plate and the fifth convex plate, the buffer pad is a soft material, and the buffer pad is in contact with a top corner portion of the display panel.

7. The packing box for the display panel according to claim 1, wherein the insert block comprises a first surface and a second surface, the first surface is located on the bottom of the insert block and attached to a surface of the box body, the second surface is disposed in parallel to and opposite to the first surface, and the accommodating slot runs through the first surface and the second surface.

8. A packing box for a display panel, the display panel comprising a circuit board and a substrate, wherein the circuit board is disposed on one side of the substrate, and a length of the circuit board is shorter than a length of the substrate, the packing box comprising:

a box body, configured to accommodate the display panel; and two grooves, disposed on the box body, wherein the box body comprises two insert blocks each configured to protect a corresponding to corner of the display panel, each of the two insert blocks comprises an accommodating slot located in the insert block, the two grooves are axial symmetrically distributed on the box body, each of the two insert blocks is connected corresponding groove and is fixed within side walls of the corresponding groove, and a desiccant is placed in the accommodating slot;

wherein the insert block comprises a through hole, a first convex plate and a second convex plate, the through hole is disposed on a convex plate of the insert block adjacent to the inside of the box body, and the through hole communicates the accommodating slot with the inside of the box body; the first convex plate and the second convex plate are in the shape of a rectangular parallelepiped, the first convex plate is fixedly connected with the insert block, the second convex plate is fixedly connected with the first convex plate, the box body comprises a first groove disposed on a side wall of the box body, the shape and size of the first convex plate and the second convex plate are equal to the shape and size of the first groove, and the first convex plate and the second convex plate are matched with the first groove;

wherein the groove is in the shape of a rectangular parallelepiped slot, the shape and size of the insert block correspond to those of the groove, and the insert block has a thickness in a range of 2 mm to 4 mm; the insert block comprises a third convex plate, the third convex plate is adjacent to a side portion of the circuit board, the through hole is located on the third convex plate, the through hole is in the shape of a rectangular parallelepiped, the upper and lower ends of the through hole run through the top end and the bottom end of the insert block, and the width of the through hole does not exceed the width of the circuit board;

the insert block comprises a fourth convex plate, a fifth convex plate and a buffer pad, the fourth convex plate is perpendicular to and fixedly connected with the fifth convex plate, the buffer pad is fixed to the outside of the fourth convex plate and the fifth convex plate, the buffer pad is a soft material, and the buffer pad is in contact with a top corner portion of the display panel; the first convex plate is located on a side portion of the fifth convex plate, the side surface of the first convex plate is in the same plane as the side surface of the fifth convex plate, and the first convex plate is fixedly connected with the fifth convex plate; and the insert block comprises a first surface and a second surface, the first surface is located on the bottom of the insert block and attached to the surface of the box body, the second surface is disposed in parallel to and opposite to the first surface, and the accommodating slot runs through the first surface and the second surface.

9. An accommodating apparatus, wherein the accommodating apparatus comprises packing boxes for a display panel that comprises a circuit board and a substrate, wherein the circuit board is disposed on one side of the substrate, and a length of the circuit board is shorter than a length of the substrate, wherein the packing boxes are stacked together, and the packing box comprises:

a box body, configured to accommodate a display panel; and two grooves, disposed on the box body, wherein the box body comprises two insert blocks each configured to protect a corresponding top corner of the display panel, each of the two insert blocks comprises an accommodating slot located in the insert block, the two grooves are axial symmetrically distributed on the box body, each of the two insert blocks is connected with the corresponding groove and is fixed within side walls of the corresponding groove, and a desiccant is placed in the accommodating slot.

10. The accommodating apparatus according to claim 9, wherein the insert block comprises a through hole, the through hole is defined in a convex plate of the insert block adjacent to the inside of the box body, and the through hole communicates the accommodating slot with the inside of the box body.

11. The accommodating apparatus according to claim 9, wherein the insert block comprises a first convex plate and a second convex plate, the box body comprises a first groove, the first convex plate and the second convex plate are in the shape of a rectangular parallelepiped, the first convex plate is fixedly connected with the insert block, the second convex plate is fixedly connected with the first convex plate, the first groove is disposed on a side wall of the box body, the shape and size of the first convex plate and the second convex plate are equal to the shape and size of the first groove, and the first convex plate and the second convex plate are matched with the first groove.

12. The accommodating apparatus according to claim 9, wherein the groove is in the shape of a rectangular parallelepiped slot, the shape and size of the insert block correspond to those of the groove, and the insert block has a thickness in a range of 2 mm to 4 mm.

13. The accommodating apparatus according to claim 11, wherein the insert block comprises a third convex plate, the third convex plate is adjacent to a side portion of the circuit board, the through hole is located on the third convex plate, the through hole is in the shape of a rectangular parallelepiped, the upper and lower ends of the through hole nm through the top end and the bottom end of the insert block, and the width of the through hole does not exceed the width of the circuit board.

14. The accommodating apparatus according to claim 13, wherein the insert block comprises a fourth convex plate, a fifth convex plate and a buffer pad, the fourth convex plate is perpendicular to and fixedly connected with the fifth convex plate, the buffer pad is fixed to the outside of the fourth convex plate and the fifth convex plate, the buffer pad is a soft material, and the buffer pad is in contact with a top corner portion of the display panel.

15. The accommodating apparatus according to claim 9, wherein the insert block comprises a first surface and a second surface, the first surface is located on the bottom of the insert block and attached to a surface of the box body, the second surface is disposed in parallel to and opposite to the first surface, and the accommodating slot runs through the first surface and the second surface.

* * * * *